US005415323A

United States Patent [19]

Fenelon

[11] Patent Number: 5,415,323

[45] Date of Patent: May 16, 1995

[54] DRY MIX DISPENSING APPARATUS AND METHOD

[76] Inventor: Terrance P. Fenelon, 173 Montrose Pl., St. Paul, Minn. 55104

[21] Appl. No.: 66,363

[22] Filed: May 24, 1993

[51] Int. Cl.[6] ..... B67B 7/00

[52] U.S. Cl. ..... 222/1; 222/181; 414/404; 414/414; 414/607; 141/114

[58] Field of Search ..... 222/1, 181, 185, 325, 222/460, 461, 561; 414/607, 404, 414, 347; 141/114, 314

[56] References Cited

U.S. PATENT DOCUMENTS

| | | | |
|---|---|---|---|
| 4,518,106 | 5/1985 | LaFluer | 222/181 X |
| 4,527,716 | 7/1985 | Haas et al. | 222/181 X |
| 4,953,752 | 9/1990 | Tousignant et al. | 222/185 X |
| 4,956,821 | 9/1990 | Fenelon | 366/8 |
| 5,069,596 | 12/1991 | Mueller et al. | 222/181 X |
| 5,184,759 | 2/1993 | Gill et al. | 222/181 |
| 5,257,725 | 11/1993 | Volk, Jr. et al. | 222/185 |

*Primary Examiner*—Gregory L. Huson
*Attorney, Agent, or Firm*—Merchant, Gould, Smith, Edell, Welter & Schmidt

[57] ABSTRACT

An improved dry mix dispensing apparatus and method for controllably dispensing materials from bulk storage bags are disclosed. A support structure is provided for elevating loaded bulk bags over a collector and discharge means that controllably empties the contents of the bag, one batch at a time, as needed, into an underlying batch mixer. The collector only processes that material currently being dispensed, and the bag continues to store the bulk material until actually dispensed through the collector. The dispensing apparatus is rapidly collapsible in the vertical and lateral directions for ease of transport and movement about the construction site.

20 Claims, 4 Drawing Sheets

DRY MIX DISPENSING APPARATUS AND METHOD

FIELD OF THE INVENTION

This invention relates generally to dispensing systems, and more particularly to portable and collapsible apparatus for dispensing dry mix or mortar from large transport container bags used in mortar delivery systems.

CROSS-REFERENCE TO RELATED PATENTS

To the extent that the disclosures and teachings of U.S. Pat. No. 4,956,821 are required for an understanding of this invention, such patent is herein incorporated by reference.

BACKGROUND OF THE INVENTION

There have been relatively few innovations in the methods of transporting and handling mortar and mortar/sand mixtures (i.e., dry mix) from the mortar preparation site to the construction site in the last decade. Introduction of the concept of premixing mortar/sand mixtures and packaging such mixtures in large quantities in weatherproof storage bags having lifting handles, has revolutionized the manner in which mortar is mixed and prepared at the construction site. A complete discussion of such process is found in my prior U.S. Pat. No. 4,956,821, the contents of which are herein incorporated by reference. The ability to premix and practically handle large quantities of mortar has greatly facilitated batch mixing operations at the construction site. As described in my prior patent, the premixed mortar is transported in large bulk bags of typically 2,000 to 3,000 pound quantities, to the construction site, where the bulk bags are unloaded into waterproof medium sized storage silos having a discharge outlet that can be selectively opened and closed to charge a batch mixer, for mixing batches of mortar, grout, or cement, as needed. In the past, it has been convenient for such medium sized silos to hold from five to seven bags of such premixed mortar at a time.

Such systems represent a vast improvement in the art and have significantly changed the dynamics of mortar preparation and handling at the construction site. In construction projects which extend over relatively long periods of time, it is practical to transport such medium sized storage silos to the construction site and to use them as described above. However, for the smaller construction projects that may require mixing of only one or two bulk bags of mortar at any one location, it may be inconvenient to transport and set up such medium sized silos for handling just several bulk bags of mortar. However, even for such smaller projects it is still desirable to use dry mortar which has been premixed and which is transportable to the site using the large bag technique.

There are other instances, even in larger construction projects wherein it may be more convenient to move the batch mixer and its supply silo between different locations at the construction site, rather than to continuously transport small batches of mixed cement from the mixer to where it is ultimately needed. However, in such cases it may be inconvenient to repetitively move a loaded storage silo around the construction site, to accommodate this need—particularly if it is substantially filled with five to seven tons of material. It would be desirable in such instances for a single bulk storage bag at a time to be elevated above a mixer and to selectively empty the bag into the mixer, for preparing a plurality of batches, until the bag is empty. However, the bulk bag technology has not heretofore accommodated such need.

To continuously elevate a mortar bulk storage bag over a batch mixer generally requires a forklift vehicle or a crane to continuously hold the bag in position. Such equipment is too expensive to inefficiently utilize in such disabling manner for any extended period of time. An alternative would be to use the lift equipment to raise the bag over the mixer to drop a batch from the bag whenever desired, and then to place the bag back into a protective storage area when not being used. However, to go through such labor intensive operations totally negates the purpose and efficiencies for which the bulk bag transport and handling concept was designed. Further, such large storage/transport bags are typically not designed for "selective" emptying since they do not have any controllable metering apparatus at their discharge ports. They usually are designed for emptying of the entire bag contents at a time and do not readily lend themselves to accurate interruption or stopping of a discharge process, with any degree of controllability, once the discharge process has been initiated. Their outlet port closure structure generally consists of a draw cord member fastened around a flexible tubular outlet chute, that once loosened, allows free discharge flow of the mortar through the chute until the entire contents of the bag passes therethrough.

Therefore, while the needs to adopt and to incorporate the advantages of the bulk transport/storage bag concepts to the smaller construction project exist, no practical approach which maintains the economies for which the system was designed has been devised in the art. The present invention provides a dispensing system that addresses these deficiencies and needs of the prior art.

SUMMARY OF THE INVENTION

The present invention provides a highly portable dispensing apparatus that can be conveniently transported to the construction site by a pickup truck and readily thereafter erected and moved from location to location about the construction site. The portable dispensing apparatus of the present invention effectively converts a large bulk dry mix storage/transport bag that is not designed to selectively dispense its contents, into a selectively dischargeable batch mixer loading dispenser. The dispensing apparatus of this invention conveniently accommodates a single bulk transport/storage dry mix bag at a time in a manner that supportively holds the bag in appropriate dispensing position for discharge of its contents, and provides a discharge metering apparatus for the bag's discharge port so that the bag contents can be selectively and controllably discharged to a batch mixer on a batch need basis, until the bag's contents is emptied. The dispenser apparatus of the present invention is collapsible and readily portable around the construction site in a safe, efficient and reliable manner by use of a simple forklift or crane that is readily available at the construction site.

According to one aspect of the invention, there is provided a portable dispenser for charging a batch mixer with powdered materials of the type carried by flexible storage containers containing multiple charges of such materials, comprising:

(a) a support frame sized and configured to rest on a support surface and to enable a portable batch mixer to be aligned at receiving station to one side of the frame;

(b) a collector suitable for continuously receiving materials from a flexible storage container, sized to retainably hold only a portion of the materials carried by the storage container;

(c) means for supporting the collector in cantilevered manner to one side of the support frame and generally overlying the receiving station;

(d) container support means operatively connected to the support frame for carrying the flexible storage container in cantilevered manner operatively overhanging and in engagement with the collector such that the materials released from the flexible container are immediately collected and retained by the collector; and (e) means operatively connected with the collector for controllably discharging the retained materials from the collector to the batch mixer at the receiving station.

According to yet another aspect of the invention, the portable dispenser as described above includes means for collapsing the dispenser in both the vertical and lateral directions for ease of transport thereof. According to a preferred configuration of such dispenser apparatus, the collector comprises a frustoconical member that continuously receives materials discharged from the flexible storage container, without spillage, but in a manner that enables controlled emptying of the storage bag through the collector.

According to yet another aspect of the invention, there is provided a portable dispenser for delivering premixed dry mortar blend materials carried by a flexible bulk storage bag of the type having an outlet chute and containing multiple batch charges of the materials, to the inlet port of a batch mixer at a receiving station, comprising:

(a) a collector having an inlet port and an outlet port and configured to continuously receive materials from the flexible storage bag through its inlet port and to direct such materials toward its outlet port, wherein the collector is sized to retainably hold only a portion of the materials carried by the storage bag;

(b) means for supporting the collector above the receiving station and for supporting the storage bag in operative overlying relationship with the collector such that the outlet chute of the bag is aligned with and addresses the collector so that flow of materials exiting from the bag are retainably redirected by the collector; and (c) discharge means operatively connected with the outlet port of the collector for controllably discharging the materials from the collector therethrough and toward the inlet port of a batch mixer at the receiving station.

According to yet a further aspect of the invention, there is provided a method for dispensing materials at a construction site from a flexible bulk storage bag of the type having an outlet discharge chute and containing a plurality of batch charges of such materials, comprising the steps of:

(a) supporting a collector having a controllable discharge means above a receiving station for a batch mixer;

(b) hanging the bulk storage bag in elevated manner over the collector;

(c) operatively fixing the height of the bag such that its outlet discharge chute operatively addresses the collector;

(d) opening the outlet chute of the bag, thereby enabling its contents to flow by gravity into the collector; and (e) controllably emptying the storage bag through said collector and said discharge means, one batch at a time.

While the invention will be described with respect to a particular preferred embodiment of a portable and collapsible dispensing apparatus, it should be noted that the invention is not to be limited by any of the specifics of construction of the preferred embodiment. Further, while the invention will be described with respect to a particular size of dispensing apparatus, the invention is not intended to be constrained by the particular size and dimensions of the preferred embodiment. As will also be appreciated by those skilled in the art, while the invention is described with respect to a paddle-wheel batch mixer, any type of portable mixer could be used within the spirit and intent of this invention. These and other features of the invention will become apparent to those skilled in the art in view of a more detailed description hereof.

BRIEF DESCRIPTION OF THE DRAWING

Referring to the figures, wherein like numerals represent like parts throughout the several views.

DETAILED DESCRIPTION OF THE INVENTION

The dispensing apparatus of the preferred embodiment is primarily a framework structure for operatively supporting a large bulk bag of the type previously described, in cantilevered manner overlying a portable batch mixer. The general application for such dispensing apparatus in the construction industry is basically the same as described in my previous U.S. Pat. No. 4,956,821, hereby incorporated by reference, and the reader is referred to such patent for a more complete description of the general art related to such dispensing technology.

Figure 3:
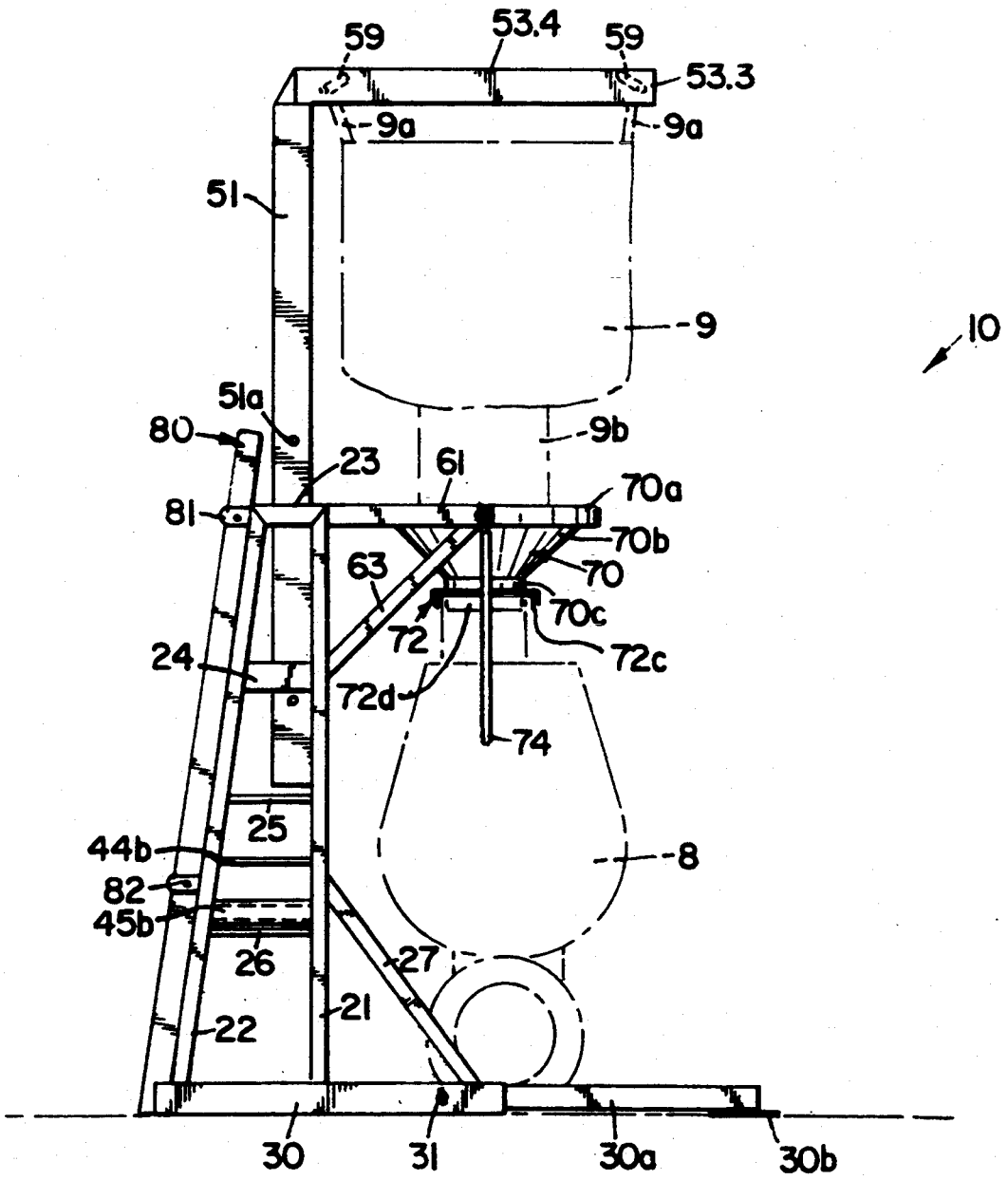
FIG. 3 is a view in side elevation of the dispensing apparatus of FIG. 1 illustrating in phantom a supported bulk bag and a portable batch mixer as they would operatively appear in association with the dispensing apparatus.

Referring to the figures, the dispensing apparatus of my invention is generally illustrated at 10. The dispenser is illustrated in FIG. 3 as supporting a large bulk bag 9 of premixed mortar or other suitable material and as operatively overlying a batch mixer, generally illustrated at 8. While such bulk bags can be of any size, the preferable configuration is one that holds approximately 30 cubic feet or 2,000 to 3,000 pounds of mortar-blend material. Bags of such size are capable of being readily handled by either a crane or forklift at the construction site, and hold adequate quantities of material so as to require fewer requirements for "loading" the dispenser apparatus. Such bags generally have two or four top mounted double lifting loops 9a that can be engaged by either a crane or forklift, and a lower outlet spout, generally designated at 9b that is closed by a safety rope member (not illustrated) prior to positioning the bag in a dispensing mode as illustrated in the figures. Details of the batch mixer 8 are not particularly relevant, since the mixer could be of any type well-known in the art suitable for accepting a charge of premixed mortar from the dispensing apparatus 10 and operatively preparing a batch of usable concrete therefrom. The most popular of such batch mixers are referred to as paddle wheel mixing machines, well-known in the art and in the construction industry; however, other mixer configurations could equally well be used with the dispenser apparatus of this invention.

Figure 1:
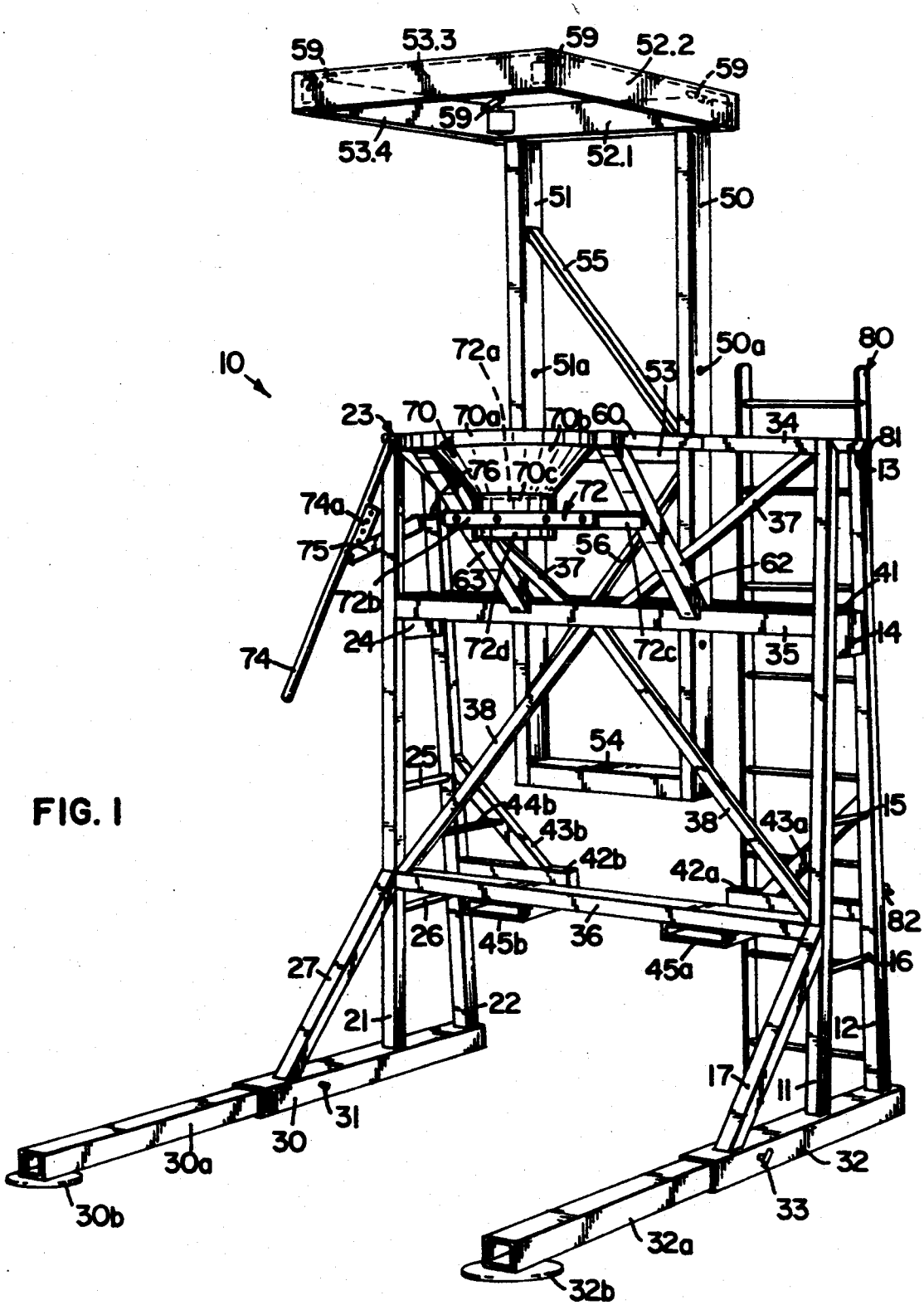
FIG. 1 is a perspective view of a dispensing apparatus constructed according to the principles of this invention and illustrated from the right front angle.
Figure 2:
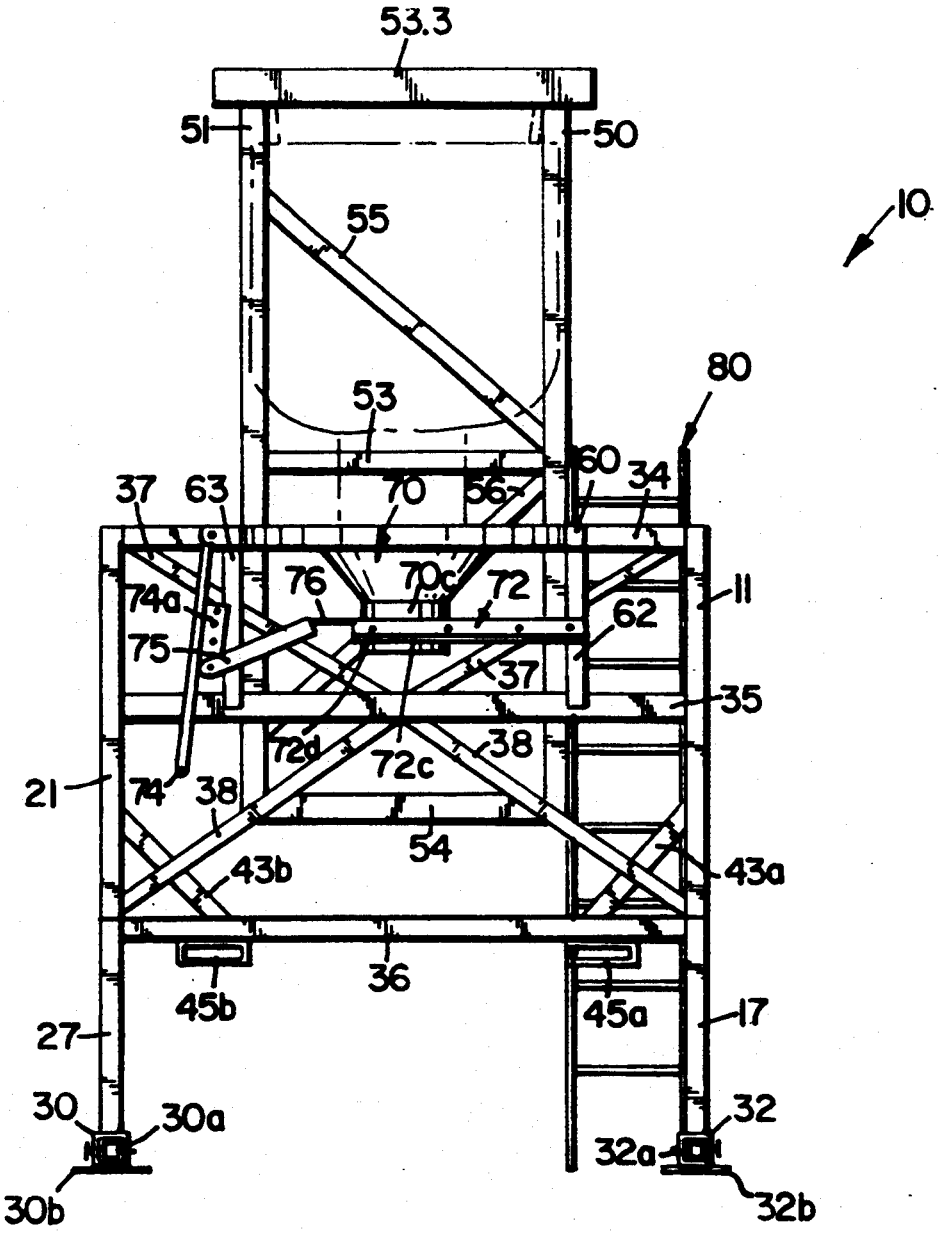
FIG. 2 is a view in front elevation of the dispensing apparatus of FIG. 1, with portions thereof broken away.

The dispenser 10 is configured in the shape of a lightweight yet structurally sound and efficient framework, sized in the preferred embodiment to be collapsible for transport within the standard box of a pickup truck. In a preferred embodiment configuration to be described, the dispensing apparatus collapses to a shipping height of 7 feet 9 inches, a width of 5 feet 9 inches and depth of 3 feet 9 inches. When in raised operative position, the dispensing apparatus can accommodate a batch mixer of 4 feet 8 inches in width and a mixing chamber height of 5 feet 6 inches. It will be understood, however, that such sizes are for illustrative purposes only and that the invention is not to be limited to any particular dimensions. Referring to FIG. 1, the dispenser of the preferred embodiment has identical right and left support frames. The right support frame has a pair of upright support standards 11 and 12, slightly converging toward one another from bottom to top. The support standard 11 is disposed near the front of the dispenser, and the support standard 12 is disposed toward the rear thereof. The upright support standards 11 and 12 are interconnected by horizontal brace members 13, 14, 15 and 16. In the preferred embodiment, the top and next lower horizontal brace members 13 and 14 respectively are of significantly heavier construction than are the other two. The left frame member comprises a mirror image of the right frame member, and includes front and rear upright support standards 21 and 22 respectively and horizontal cross brace members 23, 24, 25 and 26.

The bottoms of the upright support standards 21 and 22 of the left frame support are anchored to a first support base member 30 extending from the back upright support standard 22 and in the forward direction past the front upright support standard 21. The first base support member 30 is of tubular steel construction and defines an internal cavity in which is telescopically anchored a cooperating tubular extension 30a which can be extended in the forward direction as illustrated in FIG. 1, to provide support in the forward direction for the cantilevered structure hereinafter described. The base extension 30a includes, a disk member 30b mounted at its distal end for distributing the dispenser weight forces transmitted through the base support 30. The base extension 30a is, in the preferred embodiment, locked at an extended position relative to the first support base member 30 by means of a pin and hole assembly (as is well-known in the art) generally illustrated at 31. An angularly disposed support brace 27 connects the front upright support standard 21 and the first support base member 30.

The bottoms of the upright support standards 11 and 12 of the right frame support are anchored to a second support base member 32 extending from the back upright support standard 12 and in the forward direction past the front upright support standard 11. The second base support member 32 is of tubular steel construction and defines an internal cavity in which is telescopically anchored a cooperating tubular extension 32a which can be extended in the forward direction as illustrated in FIG. 1, to provide support in the forward direction for the cantilevered structure hereinafter described. The base extension 32a is, in the preferred embodiment, locked at an extended position relative to the second support base member 32 by means of a pin and hole assembly (as is well-known in the art) generally illustrated at 33. The base extension 32a includes a force distributing disk member 32b mounted to its distal end in manner similar to that of disk 30b. An angularly disposed support brace 17 connects the front upright support standard 11 and the second support base member 32.

The right and left frame support members are interconnected at the front of the dispenser by a plurality of interconnecting brace members. An upper horizontal brace member 34 horizontally extends between the front upright support standards 11 and 21 at the same level as the top horizontal brace members 13 and 23. A second horizontal brace 35 interconnects the upright support standards 11 and 21 at the position of the side horizontal brace members 14 and 24. A lower front horizontal brace 36 interconnects the upright support standards 11 and 21 at a position below the side horizontal braces 15 and 25 and above the bottom horizontal side braces 16 and 26. A pair of angular brace members 37 form a V-shaped brace between the extremities of the upper front horizontal brace 34 and the top center portion of the second horizontal brace 35. A second pair of angular brace members 38 form an inverted V-shaped brace structure between the lower center portion of the second horizontal brace 35 and the extremities of the lower horizontal brace 36.

The right and left frame supports are interconnected at the back of the dispenser apparatus by means of a pair of horizontal support braces 40 and 41. The brace 40 interconnects the upright support standards 22 and 12 at the top of the frame structure, and the second horizontal back brace 41 connects the upright support standards 22 and 12 at the same level of the horizontal supports 14, 35 and 24.

A pair of stud brace supports 42a and 42b extend from and are welded respectively to the back upright support members 12 and 22 respectively and extend in cantilevered manner toward one another in the general plane of the back bracing members. Angularly disposed brace members 43a and the stud brace supports 42a and 42b to their respective upright support standards 12 and 22. The angular supports 43a and 43b are respectively interconnected with the inverted V pair of angular braces 38 by means of a pair of cross brace members 44a and 44b respectively. A pair of forklift receptor channel members 45a and 45b are respectively interconnected between the stud brace supports 42a and 42b and the lower horizontal front brace 36. The forklift channels 45a and 45b are respectively horizontally aligned and are parallel to one another in spaced-apart manner so as to cooperatively accept the tines of a forklift vehicle, and are of a strength sufficient to support the weight of the dispenser apparatus.

A vertically movable structure that holds a large bulk bag in cantilevered manner is supported by the bracing structure just described. The bag support structure comprises an upright support frame having a pair of parallel spaced upright standards 50 and 51, interconnected by upper, middle and lower horizontal braces 52.1, 53 and 54 respectively, and a pair of angularly disposed cross braces 55 and 56. The upper cross brace 52.1 forms the back leg of a rectangular bag holding framework whose remaining members 52.2, 52.3 and 52.4 extend in cantilevered manner toward the front of the dispenser apparatus, and generally lie in a plane orthogonal to that formed by the members of the vertical bag support structure (50–56). A plurality of bag holder hooks, generally indicated at 59, extend, in the preferred embodiment, from the inwardly directed surfaces of the rectangular bag holder frame members 52 generally from the four corners of the frame 52, for supporting a bulk bag 9, in hanging manner therefrom by the top loops 9*a* of the bag.

The "depth" dimension of the upright standards 50 and 51 (from front to back) and their interconnecting braces are cooperatively dimensioned with respect to the top spaced cross brace members 34, 40 and the next lower spaced cross brace members 35, 41, such that the vertical frame structure defined by the members 50–56 is enabled to cooperatively slide between the spaced supports 34, 40 and 35, 41, and is cooperatively supported by such spaced cross braces. The cross brace members 34, 40 and 35, 41 cooperatively support the vertical standards 50 and 51 of the bag support structure against tipping in the forward direction. A pair of upper horizontal brace members 61 and 62 aligned in horizontal parallel manner, interconnect the front and back top horizontal braces 34 and 40 and extend in cantilevered manner forward of the front cross brace 34. A pair of angled braces 62 and 63 connect the distal ends of the upper horizontal brace members 60 and 61 respectively with the front cross brace 35. The lateral spacing between the upper brace members 60 and 61 is sized so as to cooperatively slidably engage the upright support standards 50 and 51 and to allow the vertical bag support structure 50–56 to vertically slide therebetween. A second pair of horizontal brace members (not illustrated), extend in parallel spaced apart manner from front to back between cross braces 35 and 41 and directly underlying braces 60 and 61 respectively. These cross braces, and cross braces 60 and 61 support the vertical standards 50 and 51 and their associated framework in the lateral direction of the dispenser system and keep the vertical bag support framework from tipping in the sideward direction.

Each of the upright support standards 50 and 51 has a plurality of aligned holes 50*a* and 51*a* sized to cooperatively accept pin members 50*b* and 51*b* respectively for supporting the vertical frame portion of the bag support structure at various predetermined vertical positions relative to the lower support frame. In the preferred embodiment, the pins 50*b* and 51*b* when inserted into their respective holes 50*a* and 51*a* supportively rest against the upper horizontal brace members 60 and 61 to supportively maintain the upper bag support frame 52 structure at the desired vertical elevation.

The cantilevered supports 60 and 61 cooperatively support a funnel-shaped collector member 70 therebetween. Collector 70 has, in the preferred embodiment, an upper cylindrical flange 70*a*, a frustoconical central section 70*b* and a lower cylindrical collar member 70*c*. The lower collar member 70*c* forms the discharge or outlet port for the collector 70 and is secured to a cooperatively sized upper cylindrical collar 72*a* of a gate valve 72. Gate valve 72 has in the preferred embodiment a rectangular housing 72*b*, a slidable gate member 72*c* and a lower, downwardly extending collar member 72*d*, axially aligned with upper collar 72*a* and the axis of the collector 70. The gate valve member 72*c* is horizontally slidable within the housing 72*b* to controllably and selectively open and close discharge from collector 70 through its lower collar member 70*c*, such that the volume of mortar material dispensed through the gate valve can be accurately controlled to dispense "batches" of such mortar mix into an underlying batch mixer 8.

The slidable gate member 72*c* of the gate valve 72 is actuated, in the preferred embodiment, by a lever configuration. The lever configuration includes a lever arm 74 pivotally connected at its upper end to the cantilevered support brace 61. The primary lever 74 has a flange bracket 74*a* secured to its underside and pivotally attached by means of first and second connector arms 75 and 76 to the slidable gate member 72*c* of the gate valve 72. The connector arms 75 and 76 are also pivotally connected to one another, in a manner such that pivotal actuation of the primary lever arm 74 smoothly induces longitudinal sliding motion of the slidable gate valve member 72*c* within the valve housing 72*b*. Adjustment of the connector member 75 relative to the adjustable collar 74*a* of the lever arm 74 changes the fulcrum point along the lever arm 74, as desired by the operator.

The dispensing apparatus includes a ladder 80 positioned at the back or rear of the dispensing apparatus and movable between an upright (vertical) position for transport of the dispenser apparatus, and an angled position with its top resting against the top back brace 40, when the dispenser apparatus is in an operative position. The upper portion of the ladder 80 is movably retained for safe engagement against the top back brace 40 by means of a retaining bracket assembly 81. A lower retaining bracket 82 mounted to the back upright support 12 retains the ladder 80 in its vertical position for transport, and permits release of the lower portion of the ladder to permit the base of the ladder to be swung out away from the dispenser during operative use of the apparatus.

Figure 4:
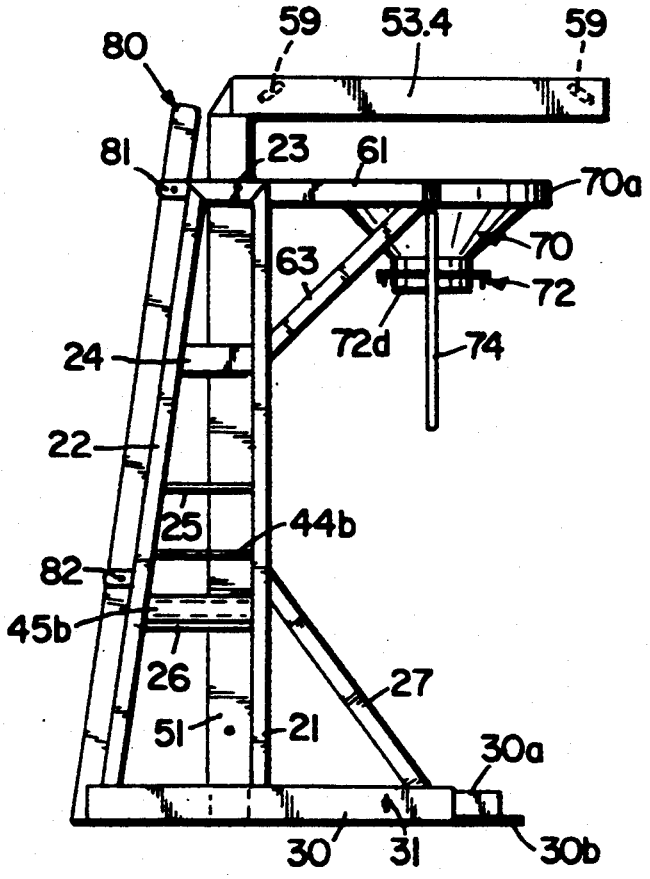
FIG. 4 is a view in side elevation similar to that of FIG. 3, illustrating the dispensing apparatus collapsed for transport.

When in "collapsed" position for transport, the pins 50*b* and 51*b* are pulled from the upright standards 50 and 51 respectively of the bulk bag supporting frame, permitting the framework 50–56 to be vertically lowered between the cross supports 34, 40 and 35, 41 until the rectangular bag support framework 52 overlies in close proximity, the collector assembly 70, as illustrated in FIG. 4. In such position, the bottom surfaces of the rectangular bag support frame 52 will cooperatively engage and rest upon the upper cross brace members 34 and 40. The handle 74 is placed in a lowered position and/or can be operatively disconnected from the gate valve assembly by decoupling the connector arm 75 from the lever 74. The pins 31 and 33 are pulled so as to allow either full retraction of the base extensions 30*a* and 32*a* respectively into their primary base sleeves 30 and 32, or are alternatively completely removed from their respective base supports 30 and 32. If the base extensions are removed from their respective supports, they are sized, in the preferred embodiment, to be placed crosswise and in stacked manner on top of the forklift sleeves 45a and 45b. When in such position, they snugly fit behind the lowered vertical standards 50 and 51 and in front of the cross brace members 43a and 43b and under the interconnecting braces 44a and 44b, and can be readily secured in place for transport, by securing means, not illustrated. When in such collapsed/transport configuration, the assembly can readily be lifted by a crane or by a forklift by means of the forklift sleeves 45a and 45b onto a trailer or bed of a transport vehicle, or into the bed of a pickup truck.

To place the dispenser apparatus in operative position at the construction site, the opposite procedure is performed. The dispenser assembly is removed by a forklift or crane and positioned at the desired location on the construction site. The leg extensions 30a and 32a are placed into their cooperating base sleeves 30 and 32 respectively and are extended to their operative position (as illustrated in FIGS. 1 and 3) and are locked in place by means of the pins 31 and 33. The bag support frame assembly comprising frame members 50-56 is vertically raised to the desired elevation, either manually or by the forklift, and is retained in such position by means of the pins 50b and 51b. The vertical position of the bag support structure will depend upon the size (i.e., vertical dimension) of the bulk bag with which the dispenser will be used. The lever arm 74 is extended to its operative position so as to close the bottom of the collector assembly 70, and if necessary is reconnected to the connector arm 76 in the process. The lower retaining bracket assembly 82 is released so as to free the bottom of the ladder for movement away from the base of the dispenser assembly. The dispenser assembly 10 is now ready to accept a bulk bag.

The open, cantilevered configuration of the dispenser apparatus enables a forklift to easily lift a bulk bag into position below the rectangular bag support framework 52 and the collector assembly 70. When the bag is so positioned, a laborer can readily climb the ladder 80, and position the loop supports 9a of the bag 9 into engagement with the bag support studs 59. The forklift can then be lowered out of engagement with the bag, which will then be fully supported by the stud supports 59 in a manner such that its lower chute 9b directly overlies and is in generally coaxial alignment with the collector 70. The bulk bag is preferably carried by the cantilevered support assembly at a height such that the lower edge of the bag chute 9b rests against and engages the inner surface of the conical portion 70b of the collector 70. Ensuring that the gate valve 72c is "closed," the retaining strap or cord on the lower chute 9b of the bag 9 can be released, causing contents of the bag to drop by gravity through the chute and into the collector 70. The downwardly depending sidewalls of the bag chute 9b, when in resting engagement or close proximity to the inner walls of the central portion 70b of the collector, will prevent the mortar mix from spilling out or overflowing from the collector 70. The upper cylindrical flange 70a of the collector also facilitates in this regard.

A batch mixer is readily positioned between the support base legs 30 and 32, as illustrated in FIG. 3, and is generally centered therebetween such that its inlet port when lifted upwardly, generally coaxially aligns with the outlet port of the overlying collector and valve assembly. Preferably, a flexible chute extension 90 is secured to the bottom collar 72d of the gate valve 72 for continuously directing discharge from the gate valve 72 into the inlet port of the batch mixer 8, as is well-known in the art. Such flexible chute or sleeve 90 also helps to reduce dust and spillage that may otherwise occur if the distance between the bottom of the valve 72 and the inlet port of the batch mixer is significant.

It will be understood by those skilled in the art, that many variations of the above-described preferred embodiment and operational use thereof, can be devised, within the spirit and intent of this invention. For example, the materials of construction, the sizes, shapes, patterns thereof, and the like can be reconfigured and redesigned—all within the spirit of this invention. The collector and gate configurations could be changed, as well as the method of delivery of the mortar from the collector to the batch mixer. While the preferred embodiment has illustrated a direct flow by gravity from the collector to the batch mixer, other forms of mortar flow, as for example by use of metered flow means, could be employed. Further, while a simple, reliable and cost effective technique has been illustrated for raising and lowering the bulk bag support assembly in the preferred embodiment, it will be understood by those skilled in the art that many other variations of this principle could be employed. These and other variations of the invention will be apparent to those skilled in the art. The invention is not to be limited by the described details of the preferred embodiment, which is intended to only represent one method of implementing the principles of the invention. The invention is to be limited only by the scope of the appended claims.

What is claimed is:

1. A portable dispenser for changing a batch mixer with powdered materials of the type carried by a flexible storage container containing multiple charges of such materials, said storage container having downwardly depending walls defining a lower outlet port, comprising:

(a) a support frame sized and configured for resting on a support surface and to enable a portable batch mixer to be aligned at a receiving station to one side thereof;

(b) a collector suitable for continuously receiving materials from a flexible bulk storage container, sized to retainably hold only a portion of the materials carried by said storage container;

(c) means for supporting said collector in fixed cantilevered manner to one side of said support frame and generally overlying said receiving station;

(d) container support means operatively connected to said support frame for supporting the flexible storage container in cantilevered manner in operative unattached overlying juxtaposition with said collector such that said materials released through said outlet port of said flexible container are immediately collected and retained by said collector; and such that said container walls, in combination with said collector, contain said material leaving said outlet port to said collector; and (e) means operatively connected with said collector for controllably discharging said retained materials from said collector to the batch mixer at said receiving station.

2. The dispenser as recited in claim 1, wherein said collector comprises a frustoconical receptor member.

3. The dispenser as recited in claim 2, wherein said flexible storage container is of the type having a discharge chute of generally cylindrical shape; wherein said collector support means orients said collector such that the wider diameter portion of said frustoconical receptor member operatively addresses the discharge chute of said storage container; wherein the wider diameter portion of said receptor member has a diameter that significantly exceeds that of said discharge chute; and wherein the outlet end of said discharge chute engages an inner surface of the receptor member.

4. The dispenser apparatus as recited in claim 1, wherein said means for controllably discharging said retainably held materials from said collector comprises a slidable gate valve.

5. The dispenser as recited in claim 1, wherein said means for discharging said materials from said collector comprises means for allowing said discharged materials to flow by gravity into the batch mixer at said receiving station.

6. The dispenser as recited in claim 5, wherein said means for discharging said materials includes an elongated flexible sleeve member operatively connected with said collector for guiding said discharged material from said collector to said batch mixer.

7. The dispenser as recited in claim 1, wherein said container support means includes means for selectively adjusting the vertical height of said flexible container relative to that of said collector.

8. The dispenser as recited in claim 7, wherein said support frame is collapsible for transport.

9. The dispenser as recited in claim 8, wherein said container support means is collapsible vertically toward said collector.

10. The dispenser as recited in claim 1, wherein said support frame includes base means laterally extendible in the direction of said receiving station.

11. The dispenser as recited in claim 10, wherein said support frame is collapsible for transport.

12. The dispenser as recited in claim 1, wherein said container support means comprises means for hanging said flexible storage container in operative overlying engagement with said collector.

13. A portable dispenser for delivering premixed dry mortar-blend materials carried by a flexible bulk storage bag of the type having an outlet chute and containing multiple batch charges of said materials, to the inlet port of a batch mixer at a receiving station, comprising:

(a) a collector having an inlet port and an outlet port and configured to continuously receive said materials from the flexible storage bag through its inlet port and to direct such materials toward its outlet port, said collector being sized to retainably hold only a portion of the materials carried by said storage bag;

(b) means for supporting said collector above said receiving station and for supporting said storage bag in operative overlying but unattached relationship with said collector, with the outlet chute of said bag being aligned with and addressing said collector such that flow of said materials exiting from said bag are retainably redirected by said collector; and (c) discharge means operatively connected with the outlet port of said collector for controllably discharging said materials from said collector therethrough and toward the inlet port of a batch mixer at said receiving station; wherein said discharge means causes said materials to leave said bag in real time in direct proportion to the amount of said materials discharged by said discharge means.

14. The dispenser as recited in claim 13, wherein said means for supporting said storage bag comprises means for operatively hanging said storage bag over said collector such that said material contents of said storage bag freely flow out of said bag chute under the control of said collector and said discharge means.

15. The dispenser as recited in claim 13, wherein said discharge means includes means for gradually discharging said materials from said collector and to the inlet port of the batch mixer, one batch at a time.

16. The dispenser as recited in claim 13, wherein said means for supporting said storage bag comprises means for adjustably changing the relative vertical position of said storage bag relative to said collector.

17. The dispenser as recited in claim 16, wherein said vertical adjustment means enables said storage bag support means to be collapsed vertically downward for transport when a storage bag is not being supported thereby.

18. The dispenser as recited in claim 13, wherein said collector comprises a downwardly converging frustoconical funnel member.

19. A method of dispensing materials at a construction site from a flexible bulk storage bag of the type having an outlet discharge chute and containing a plurality of batch charges of such materials, comprising the steps of:

(a) supporting a collector having a controllable discharge means, above a receiving station for a batch mixer;

(b) hanging the bulk storage bag in elevated manner over said collector;

(c) operatively fixing the height of the bag such that its outlet discharge chute operatively addresses and is juxtapositioned over but unattached to the collector;

(d) opening the outlet discharge chute of the bag, enabling its contents to flow by gravity into said collector;

(e) controllably emptying said materials from said storage bag, through said collector and discharge means, one batch at a time; and (f) directing by gravity the emptied materials, from said collector to said receiving station.

20. The method as recited in claim 19, wherein said step of supporting said collector above a receiving station comprises the step of supportively suspending said collector in cantilevered manner above the receiving station.

* * * * *

UNITED STATES PATENT AND TRADEMARK OFFICE
CERTIFICATE OF CORRECTION

PATENT NO. : 5,415,323

DATED : May 16, 1995

INVENTOR(S) : Terrance P. Fenelon

It is certified that error appears in the above-identified patent and that said Letters Patent is hereby corrected as shown below:

Column 10, line 32, delete "changing" and insert in place thereof --charging--

Signed and Sealed this

Twelfth Day of September, 1995

*Attest:*

*Attesting Officer*

BRUCE LEHMAN

*Commissioner of Patents and Trademarks*